US011779497B2

(12) United States Patent
Phan et al.

(10) Patent No.: US 11,779,497 B2
(45) Date of Patent: Oct. 10, 2023

(54) PATIENT TRANSPORT APPARATUS HAVING COORDINATED USER INPUT DEVICES

(71) Applicant: Stryker Corporation, Kalamazoo, MI (US)

(72) Inventors: Hieu Phan, Portage, MI (US); Richard A. Derenne, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 18/083,996

(22) Filed: Dec. 19, 2022

(65) Prior Publication Data

US 2023/0117638 A1 Apr. 20, 2023

Related U.S. Application Data

(63) Continuation of application No. 17/559,049, filed on Dec. 22, 2021, now Pat. No. 11,559,443, which is a continuation of application No. 16/953,980, filed on Nov. 20, 2019, now Pat. No. 11,234,872.

(60) Provisional application No. 62/938,386, filed on Nov. 21, 2019.

(51) Int. Cl.
*A61G 1/02* (2006.01)
*A61G 1/048* (2006.01)

(52) U.S. Cl.
CPC ..... *A61G 1/0287* (2013.01); *A61G 1/048* (2013.01); *A61G 2203/10* (2013.01)

(58) Field of Classification Search
CPC ... A61G 1/00; A61G 1/02; A61G 1/04; A61G 1/0287; A61G 1/048; A61G 2203/10; A61G 7/0528; A61G 7/08
See application file for complete search history.

(56) References Cited

U.S. PATENT DOCUMENTS

| | | | | |
|---|---|---|---|---|
| 5,806,111 | A | 9/1998 | Heimbrock et al. | |
| 7,882,582 | B2 | 2/2011 | Kappeler et al. | |
| 7,953,537 | B2 | 5/2011 | Bhai | |
| 8,474,073 | B2 | 7/2013 | Hamberg et al. | |
| 10,806,653 | B2 | 10/2020 | Upchurch et al. | |
| 11,234,872 | B2 | 2/2022 | Phan et al. | |
| 2009/0188731 | A1* | 7/2009 | Zerhusen ..... | A61G 7/05 180/19.3 |
| 2014/0165290 | A1 | 6/2014 | Koors et al. | |
| 2019/0183701 | A1 | 6/2019 | Kloka | |
| 2019/0201256 | A1* | 7/2019 | Derenne ..... | A61G 7/0528 |
| 2019/0328594 | A1 | 10/2019 | Meng et al. | |

(Continued)

*Primary Examiner* — Fredrick C Conley
(74) *Attorney, Agent, or Firm* — Howard & Howard Attorneys PLLC

(57) ABSTRACT

A patient transport apparatus transports a patient over a floor surface and includes a support structure and a plurality of support wheels coupled to the support structure. The patient transport apparatus also includes a user interface including at least two handles coupled to the support structure, with each of the handles movable between a stowed position and non-stowed position. The patient transport apparatus also includes a user input device coupled to the user interface, and a controller coupled to the user interface. The controller is configured to electronically coordinate the movement of the handles to the stowed position upon actuation of the user input device.

20 Claims, 4 Drawing Sheets

(56) References Cited

U.S. PATENT DOCUMENTS

| | | | |
|---|---|---|---|
| 2021/0154061 | A1 | 5/2021 | Phan et al. |
| 2022/0110805 | A1 | 4/2022 | Phan et al. |

* cited by examiner

PATIENT TRANSPORT APPARATUS HAVING COORDINATED USER INPUT DEVICES

CROSS-REFERENCE TO RELATED APPLICATIONS

This application is a Continuation of U.S. patent application Ser. No. 17/559,049 filed on Dec. 22, 2021, which is a Continuation of U.S. patent application Ser. No. 16/953,980 filed on Nov. 20, 2020 and issued as U.S. Pat. No. 11,234,872 on Feb. 1, 2022, which claims priority to and the benefit of U.S. Provisional Patent Application No. 62/938,386 filed on Nov. 21, 2019, the disclosures of each of which are hereby incorporated by reference in their entirety.

BACKGROUND

Patient transport systems facilitate care of patients in a health care setting. Patient transport systems comprise patient transport apparatuses such as, for example, hospital beds, stretchers, cots, wheelchairs, and chairs, to move patients between locations. A conventional patient transport apparatus comprises a base, a patient support surface, and several support wheels, such as four swiveling caster wheels. Often, the patient transport apparatus has at least one drive wheel, in addition to the four caster wheels. The drive wheel is employed to assist a user in moving the patient transport apparatus in certain situations.

When the user wishes to employ the drive wheel to help move the patient transport apparatus, such as down long hallways, the user may interface with a user input device that causes the drive wheel to be driven by a powered drive system such that the patient transport apparatus moves without the caregiver being required to exert a substantial, external force on the patient transport apparatus.

The user input devices are typically in the form of a handle or pair of handles, which are located at the foot end, head end and/or along the sides of the patient transport apparatus. When the user input devices are not in use, such as when the patient transport apparatus is parked, it is sometimes desirable to place these user input devices in a stowed position such that these user input devices do not obstruct a caregiver's access to the patient. In these instances, it is also desirable that these user input devices are easily returned to the non-stowed, or use position, for subsequent use.

A patient transport apparatus designed to overcome one or more of the aforementioned challenges is desired.

DETAILED DESCRIPTION

Figure 1:
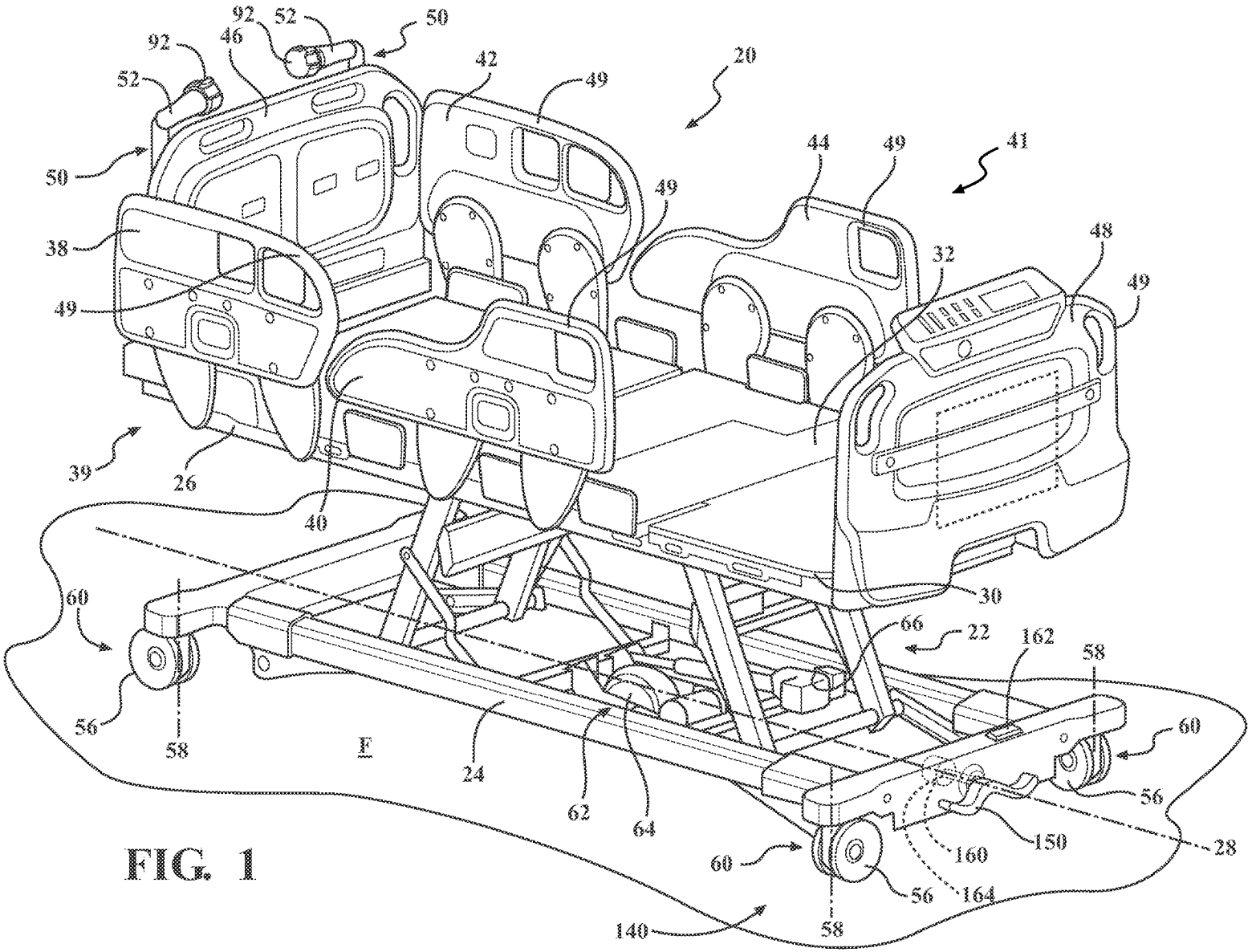
FIG. 1 is a perspective view of a patient transport apparatus.

Referring to FIG. 1, a patient transport system comprising a patient transport apparatus 20 is shown for supporting a patient in a health care setting. The patient transport apparatus 20 illustrated in FIG. 1 comprises a hospital bed. In other embodiments, however, the patient transport apparatus 20 may comprise a stretcher, a cot, a wheelchair, and a chair, or similar apparatus, utilized in the care of a patient to transport the patient between locations.

A support structure 22 provides support for the patient. The support structure 22 illustrated in FIG. 1 comprises a base 24 and an intermediate frame 26. The base 24 defines a longitudinal axis 28 from a head end to a foot end. The intermediate frame 26 is spaced above the base 24. The support structure 22 also comprises a patient support deck 30 disposed on the intermediate frame 26. The patient support deck 30 comprises several sections, some of which articulate (e.g., pivot) relative to the intermediate frame 26, such as a fowler section, a seat section, a thigh section, and a foot section. The patient support deck 30 provides a patient support surface 32 upon which the patient is supported.

A mattress, although not shown, may be disposed on the patient support deck 30. The mattress comprises a secondary patient support surface upon which the patient is supported. The base 24, intermediate frame 26, patient support deck 30, and patient support surface 32 each have a head end and a foot end corresponding to designated placement of the patient's head and feet on the patient transport apparatus 20. The construction of the support structure 22 may take on any known or conventional design, and is not limited to that specifically set forth above. In addition, the mattress may be omitted in certain embodiments, such that the patient rests directly on the patient support surface 32.

Side rails 38, 40, 42, 44 are supported by the base 24. A first side rail 38 is positioned at a right head end of the intermediate frame 26. A second side rail 40 is positioned at a right foot end of the intermediate frame 26. A third side rail 42 is positioned at a left head end of the intermediate frame 26. A fourth side rail 44 is positioned at a left foot end of the intermediate frame 26. The side rails 38, 40, 42, 44 may be connected to the intermediate frame 26 and/or the patient support deck 30. If the patient transport apparatus 20 is a stretcher, there may be fewer side rails. The side rails 38, 40, 42, 44 are movable between a raised position in which they block ingress and egress into and out of the patient transport apparatus 20 and a lowered position in which they are not an obstacle to such ingress and egress. The side rails 38, 40, 42, 44 may also be movable to one or more intermediate positions between the raised position and the lowered position. In still other configurations, the patient transport apparatus 20 may not comprise any side rails. The outer surfaces of the side rails 38 and 40 define a right side 39 of the patient transport apparatus 20 extending between the head end and the foot end of the patient transport apparatus 20, while the corresponding outer surfaces of the side rails 42, 44 define a left side 41 extending between the head end and the foot end of the patient transport apparatus 20.

A headboard 46 and a footboard 48 are coupled to the intermediate frame 26. In other embodiments, when the headboard 46 and footboard 48 are provided, the headboard 46 and footboard 48 may be coupled to other locations on the patient transport apparatus 20, such as the base 24. In still other embodiments, the patient transport apparatus 20 does not comprise the headboard 46 and/or the footboard 48. Fixed handles 49 may be integrated into any one or more of the side rails 38, 40, 42, 44, headboard 46, or footboard 48.

The patient transport apparatus 20 also includes support wheels 56 which are coupled to the base 24 to support the base 24 on the floor surface F such as a hospital floor. The support wheels 56 allow the patient transport apparatus 20 to move in any direction along the floor surface by swiveling to assume a trailing orientation relative to a desired direction of movement. In the embodiment shown in FIGS. 1 and 2, the support wheels 56 comprise four support wheels each arranged in corners of the base 24. The support wheels 56 shown are caster wheels able to rotate and swivel about swivel axes 58 during transport. Each of the support wheels 56 forms part of a caster assembly 60. Each caster assembly 60 is mounted to the base 24. It should be understood that various configurations of the caster assemblies 60 are contemplated. In addition, in some embodiments, the support wheels 56 are not caster wheels and may be non-steerable, steerable, non-powered, powered, or combinations thereof. Additional support wheels 56 are also contemplated.

Figure 2:
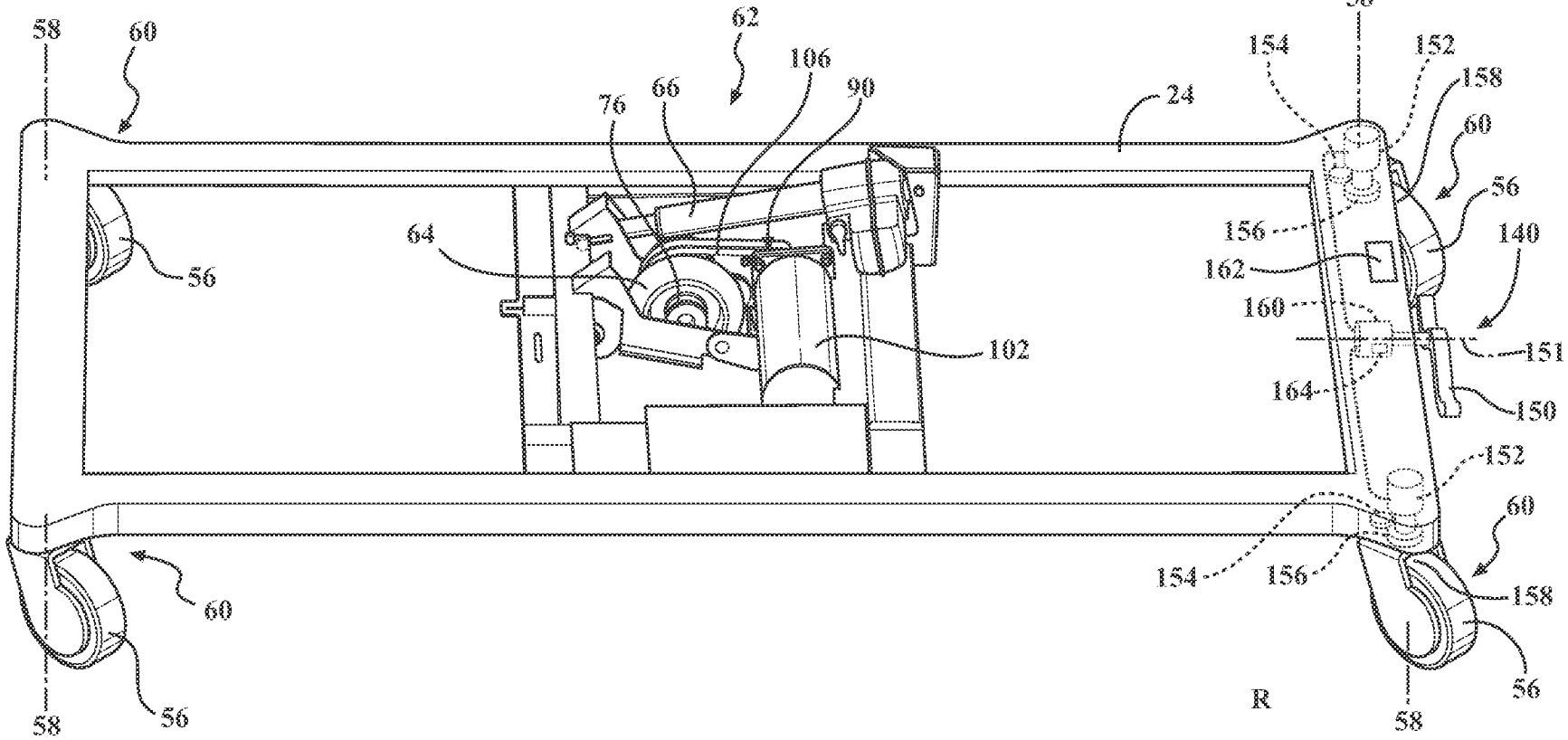
FIG. 2 is a perspective view of a drive wheel assembly of the patient transport apparatus coupled to a base of the patient transport apparatus.

As also shown in FIGS. 1 and 2, the patient transport apparatus 20 may also include a drive wheel assembly 62 that is coupled to the base 24. The drive wheel assembly 62 influences motion of the patient transport apparatus 20 during transportation over a floor surface. The drive wheel assembly 62 comprises a drive wheel 64. In many embodiments, the drive wheel assembly 62 further comprises a lift actuator 66 operatively coupled to the drive wheel 64 that is operable to move the drive wheel 64 between a deployed position engaging the floor surface and a retracted position spaced away from and out of contact with the floor surface F. In some embodiments, the drive wheel assembly 62 comprises an additional drive wheel movable with the drive wheel 64 between the deployed position and the retracted position via the lift actuator 66. By deploying the drive wheel 64 on the floor surface F in the deployed position, the patient transport apparatus 20 can be easily moved down long, straight hallways or around corners, owing to a non-swiveling nature of the drive wheel 64.

Figure 3:
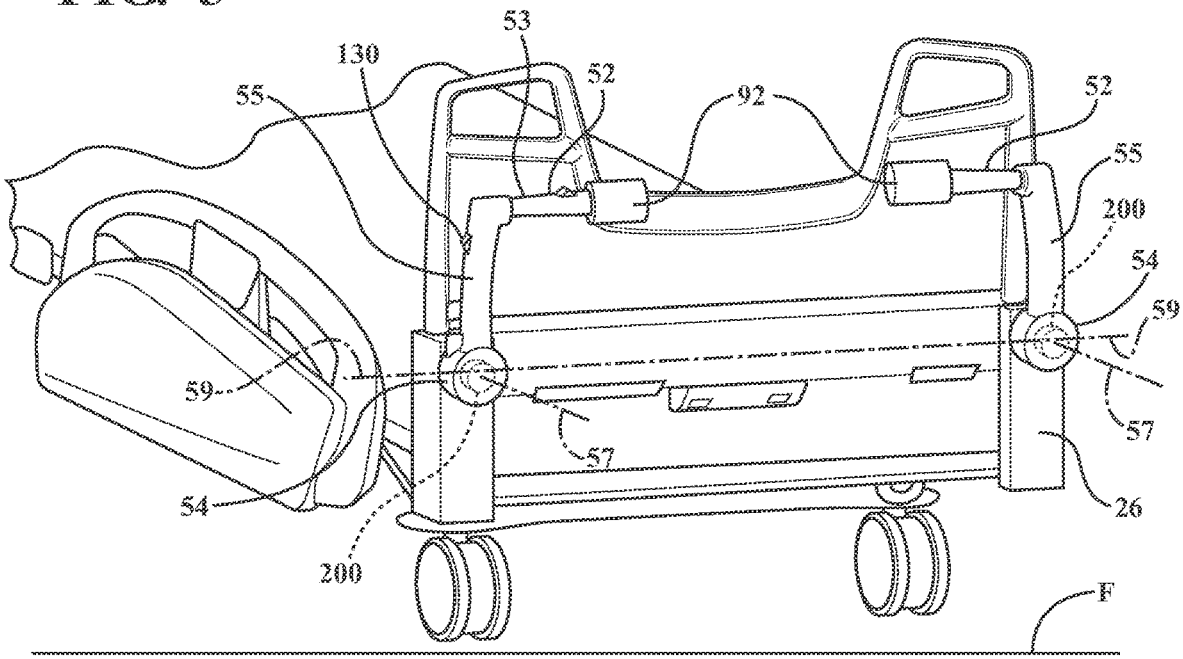
FIG. 3 is a side perspective view of a pair of handles in a non-stowed position.
Figure 4:
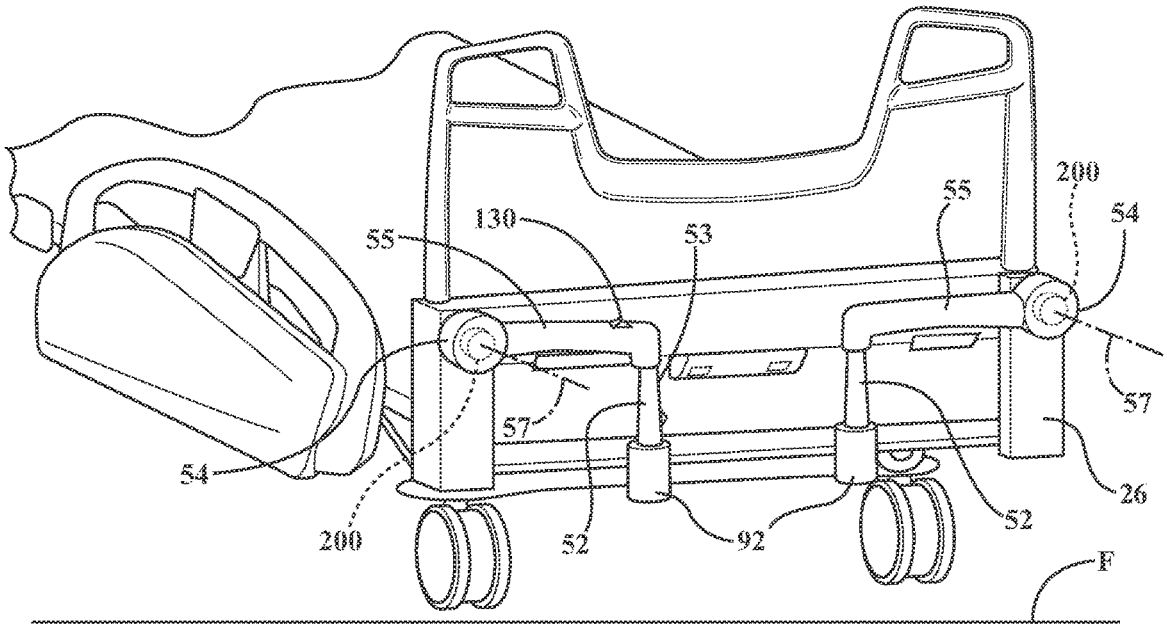
FIG. 4 is a side perspective view of FIG. 3 with the pair of handles placed in the stowed position.

In the embodiment as also shown in FIG. 2, the drive wheel assembly 62 comprises a powered drive system 90 operatively coupled to the drive wheel 64. The powered drive system 90 is configured to drive (e.g. rotate) the drive wheel 64 in response to the actuation of a user input device operable by the user. The powered drive system 90 comprises a motor 102. The powered drive system 90 further comprises a gear train 106 coupled to the motor 102 and an axle 76 of the drive wheel 64. As shown in FIGS. 1, 3 and 4, a user input device, shown herein as a throttle 92, is provided.

The exemplary drive wheel assembly 62 and throttles 92, as described herein, are also described in U.S. patent application Ser. No. 16/222,510, entitled "Patient Transport Apparatus with Controlled Auxiliary Wheel Speed," filed on Dec. 17, 2018, the disclosure of which is hereby incorporated by reference in its entirety. It should be appreciated that other configurations of the drive wheel assembly 62 and throttles 92 are also contemplated.

The patient transport apparatus also includes one or more user interfaces 50. Each user interface 50 may comprise a handle 52. The embodiment shown in FIG. 1 comprises two handles 52. The handles 52 are configured to facilitate the movement of the patient transport apparatus 20 over floor surfaces. The individual handles 52 are graspable by the user to manipulate the patient transport apparatus 20 for movement. The throttle 92 may be integrated into one or both of the handles 52, for instance, to rotate relative to the handles 52 to provide input to cause actuation of the drive wheel assembly 62 (two throttles 92 are shown).

In certain embodiments, referring to FIGS. 3 and 4, each of the handles 52 has a base portion 54 configured for coupling to the intermediate frame 26, but could likewise be coupled to any component of the patient transport apparatus 20, such as coupled to the headboard 46, footboard 48, etc. The handles 52 also have an end portion 53 remote from the base portion 54 that the user grasps the move or otherwise control the patient transport apparatus 20. In certain embodiments, these at least two handles 52 are respectively moveable between a non-stowed position and a stowed position.

The non-stowed position of a respective handle 52 refers to the positioning of the respective handle 52 relative to the patient transport apparatus 20 such that the end portion 53 of the handle 52 may be easily grasped by the user to move the patient transport apparatus 20, or in conditions wherein it is desirable for controlling the patient transport apparatus 20 for a particular reason (such as when the patient transport apparatus 20 is being raised or lowered or wherein a patient is being removed or placed on the patient support deck 30, or when control of the patient transport apparatus 20 using the set of user interfaces 50 is otherwise desired).

As illustrated in FIGS. 1 and 3, the non-stowed position is a position in which the end portion 53 of a respective handle 52 is positioned above its corresponding base portion 54 relative to the floor surface F. In certain of these embodiments, the end portion 53 of a respective handle 52 is positioned above the intermediate frame 26 relative to the floor surface F.

Conversely, the stowed position refers to a positioning of a respective handle 52 that is moved to a secondary position wherein the end portions 53 are lowered to a position closer to the floor surface F as compared to the non-stowed position. In this secondary position, the handles 52 are less likely to obstruct a user from access to a patient on the patient support deck 30. In addition, the stowed position may allow easier access for a user in traversing around the exterior of the patient transport apparatus 20.

In certain embodiments, the movement of the respective handle 52 from the non-stowed position to the stowed position is accomplished by rotating the handle 52 in a first rotational direction about an axis defined by the base portion 54 of the handle 52 such that the end portion 53 of the respective handle 52 is moved to a position closer to the floor surface F. In these embodiments, the movement of the respective handle 52 from the stowed position to the non-stowed position is accomplished by rotating the handle 52 in a second rotational direction opposite the first rotational direction about the axis defined by the base portion 54 such that the end portion 53 of the respective handle 52 is moved further away from the floor surface F. By way of example, and as illustrated in FIGS. 3 and 4, wherein a pair of the handles 52 are pivotally connected to the intermediate frame 26, the rotation of the respective handles 52 from the non-stowed position to the stowed position is accomplished by rotating the pair of handles 52 about an axis 57 defined by their respective base portion 54 such that the respective end portions 53 of the pair of handles 52 are positioned adjacent to one another (see FIG. 3) and closer to the floor surface F, whereas the subsequent rotation of the respective handles 52 from the stowed position to the non-stowed position is accomplished by rotating the pair of handles 52 about the axis 57 such that the respective end portions 53 of the pair of handles 52 are spaced further apart from each other, and wherein the end portion 53 of the respective handle 52 is located above its base portion 54 relative to the floor surface F.

In alternative embodiments, the movement of the respective handle 52 between the stowed position and the non-stowed position may be accomplished in a variety of different ways. For example, as opposed to rotating the handles 52 respectively inwardly towards one another about the axis 57 as in FIGS. 3 and 4, the handles 52 may be rotated about an axis that is transverse to the axis 57 as illustrated in FIGS. 3 and 4 (shown as axis 59 that extends along the length of the end portions 53 of the handles 52 as in FIG. 3). Accordingly, during the course of the movement from the stowed position to the non-stowed position, or vice versa), the end portions 53 of the handles 52 first pivot around the axis 59 outwardly in a direction away from the respective headboard 46, or the footboard 48, and/or the side rails 38, 40, 42, 44, and then respectively pivot back inward towards the respective headboard 46, or the footboard 48, and/or the side rails 38, 40, 42, 44. Accordingly, during the movement from the non-stowed position to the stowed position, the length of the end portions 53 of the handles 52 remains parallel to the axis 59 at all times. Further, the positioning of the end portions 53 of the handles 52 is closer to the floor surface F in the stowed position as compared to the non-stowed position in this alternative rotational method.

Still further, in other alternative embodiments, the movement between the stowed position and the non-stowed position may be accomplished via a non-rotational movement. For example, the handles 52 may be coupled to the respective headboard 46, or the footboard 48, and/or the side rails 38, 40, 42, 44 such that they may be respectively moved linearly upward or downward between the stowed and non-stowed position (i.e., the handles 52 do not rotate about axis 57 or 59 between the stowed and non-stowed position).

In even further embodiments not shown, the movement of each respective one of at least two handles 52 may move in independently different ways between the stowed and non-stowed position. For example, one handle 52 may be rotated in the manner illustrated in FIGS. 3 and 4 about axis 57 between the non-stowed and stowed positions, while another handle 52 may be rotated in the transverse rotational direction about axis 59 between the non-stowed position and stowed position, and/or the other handle 52 may be moved linearly without rotation as described above.

In some embodiments, the movement of the at least two handles 52 of the user interface 50 from the stowed position to the non-stowed position, or from the non-stowed position to the stowed position, is coordinated. The coordinated movement of the handles 52 is accomplished wherein the at least two handles 52 are linked together electronically or mechanically.

In one version in which the handles 52 are linked together electronically, the handles 52 each include an actuator device 200 coupled a controller 126 of a control system 124. The actuator device 200 is configured to move the respective handle 52 from the stowed position to the non-stowed position, or from the non-stowed position to the stowed position upon receipt of an electronic signal sent by the controller 126.

Figure 5:
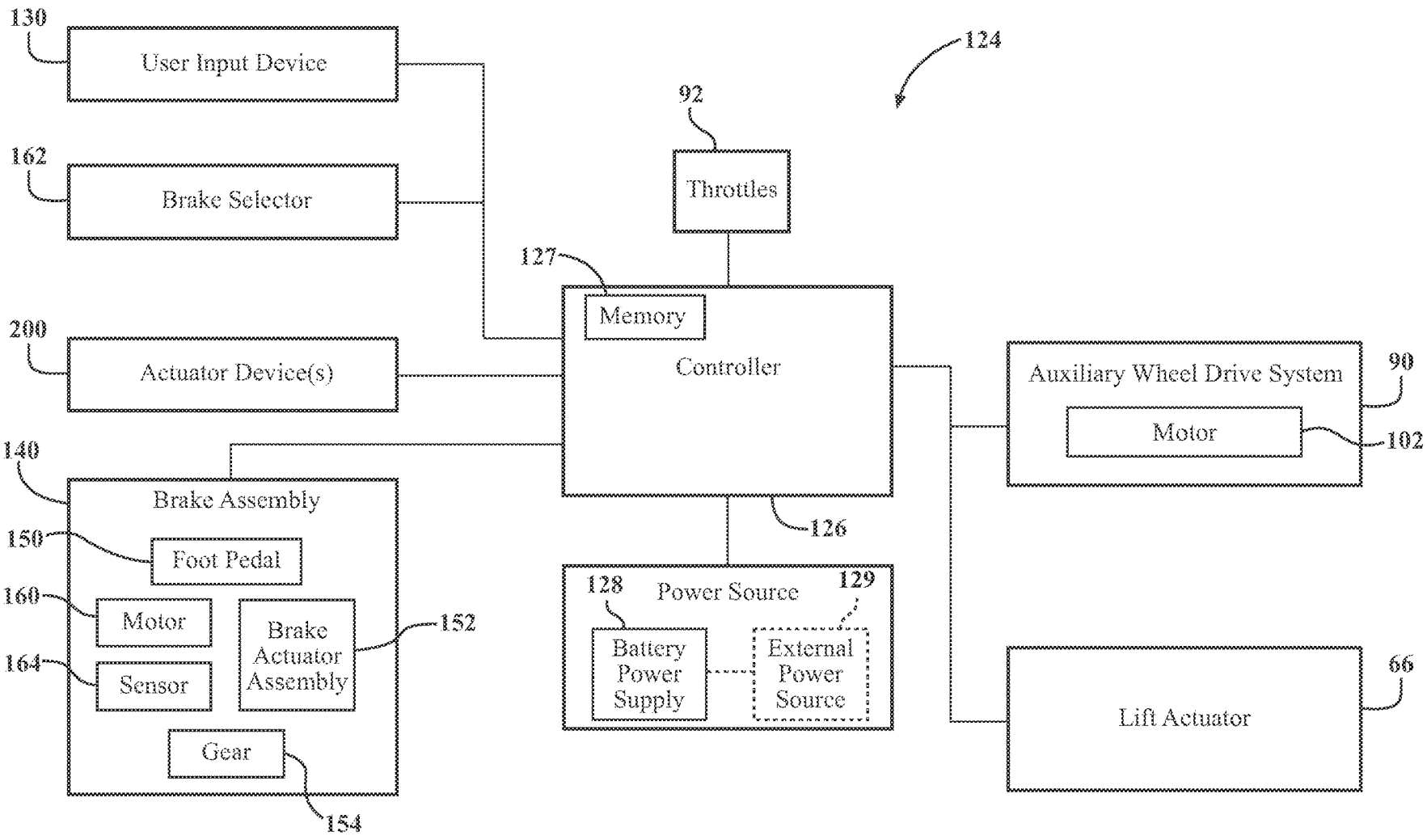
FIG. 5 is a schematic view of a control system of the patient transport apparatus.

For example, in one embodiment as illustrated in FIGS. 3-5, the actuator device 200 of a respective handle 52 is in the form of a servo motor that is electrically coupled to the controller 126. In some embodiments, the patient transport apparatus 20 includes a user input device 130 coupled to the user interface 50 and to the controller 126. The user input device 130 is configured to be selectable by a user to control the coordinated movement of the linked at least two handles 52 between the stowed position and the non-stowed position. The user input device 130 may generate one or more signals sent to the controller 126 to cause movement of the handles 52. The controller 126 receives the signal(s) and commands the actuator device 200 (such as commanding the servo motor) to rotate or otherwise move the handles 52 from the stowed position to the non-stowed position, or vice versa, in a coordinated manner, e.g., simultaneously. The user input device 130 may comprise a pair of switches (one for moving to the stowed position and one for moving to the non-stowed position) that cause the actuator device 200 to move when one of the switches is in a closed state. The controller 126 could respond to detecting the closed state by generating an appropriate command signal to the actuator devices 200 to rotate either clockwise or counterclockwise. The user input device 130 may also require constant actuation (e.g., continue depressing one of the switches to the closed state) to continue movement of the handles 52 between positions, or may simply require a single actuation (e.g., a single press of the switch). The user input device 130 may comprise a toggle switch (as shown in FIGS. 3 and 4) to toggle between moving toward the stowed position or the non-stowed position, with a neutral toggle position resulting in no movement. The user input device 130 may be in the form of one or more buttons, dials, sliding switches, touch sensors, toggle switches, touch screens, or the like.

In certain embodiments, referring back to FIG. 2, the patient transport apparatus also includes a brake assembly 140 coupled to one or more of the caster assemblies 60 that, when actuated, restricts the movement of one or more of the support wheels 56 of the patient transport apparatus 20.

The brake assembly 140 includes a foot pedal 150 that is rotatably mounted to a brake actuator assembly 152. The brake actuator assembly 152, shown in FIGS. 1 and 2 as being positioned within the base 24, may include a plurality of gears 154 such that the rotation of the foot pedal 150 engages the plurality of gears 154 to rotate in response. The gears 154 are remotely connected to an engageable device 156 having an engageable surface 158 that is moveable, based upon the rotation of the gears 154, between an engaged position and a disengaged position with one or more of the support wheels 56 of the caster assembly 60. The engageable device 156, in certain embodiments, is a brake pad.

Accordingly, when the user applies force to rotate the foot pedal 150 about a rotational axis 151 in a first rotational direction to place the brake assembly 140 in an engaged position corresponding to a braked state, the foot pedal 150 translates the rotational force through the plurality of gears 154 of the brake actuator assembly 152 to the engageable device 156 to move the engageable surface 158 into contact with the support wheel 56. In this engaged position, the contacting of the engageable surface 158 with the support wheel 56 prevents the support wheel 56 from rotating freely about its rotational axis in a clockwise or counterclockwise direction, despite force possibly being applied to the patient transport apparatus 20 to attempt move the patient transport apparatus 20 along the floor surface F. The engaged position is also alternatively referred to as the braked position.

Conversely, when the user applies force to move the foot pedal 150 in a second rotational direction opposite the first rotational direction and back to its original position, the rotation of the foot pedal 150 is translated through the plurality of gears 154 of the brake actuator assembly 152 to the engageable device 156 to move the engageable surface 158 out of contact with support wheel 56, thereby placing the brake assembly 140 in a disengaged or unbraked position. In this disengaged position, the support wheel 56 is free to rotate about rotational axis R in a clockwise or counterclockwise direction upon the application of force on the patient transport apparatus 20 by a user.

The placement (i.e., movement) of the brake assembly 140 into the braked or engaged position can prompt the controller 126 to coordinate the movement of the at least two handles 52 of the user interface 50 to the stowed position. Stated another way, the controller 126 is configured to electronically coordinate the movement of the at least two handles 52 to the stowed position when the brake assembly 140 is moved, or otherwise placed, in the braked or engaged position.

In certain embodiments, an electronic braking signal is sent to the controller 126, corresponding to movement of the brake assembly 140 to the engaged or braked position, that is also interpreted by the controller 126 to electronically coordinate the movement of the linked handles 52 to the stowed position. For instance, since the user has decided to stop movement of the patient transport apparatus 20, the handles 52 are no longer needed, at least for the time that the brake assembly 140 is engaged. Further, in certain embodiments, the electronic braking signal that is sent to the controller 126, corresponding movement of the brake assembly 140 to the disengaged or non-braked position, may also interpreted by the controller 126 to electronically coordinate the movement of the linked handles 52 to the non-stowed position. Stated another way, the controller 126 may also be configured to electronically coordinate the movement of the at least two handles 52 to the non-stowed position when the brake assembly 140 is moved, or otherwise placed, in the disengaged or unbraked position. In embodiments including the afore-mentioned servo motor that is used to move the handles, the controller 126 commands the respective servo motor of the at least two of the linked handles 52 to rotate or otherwise move in a like manner, i.e., to rotate or move in a coordinated manner in either the first or second direction to the stowed or non-stowed position, as described above on the basis of the received electronic braking signal.

In certain embodiments, as noted above, the movement of the brake assembly 140 to the braked position includes wherein the user applies force to the foot pedal 150 to rotate the foot pedal 150 in the first rotational direction. In these embodiments, the brake assembly 140 may include a brake sensor 164 that is coupled between the foot pedal 150 or other components of the brake actuator assembly 152 and the controller 126. The brake sensor 164, which may be in the form of a potentiometer or other sensor device, senses a change in position of the foot pedal 150 or other component of the brake actuator assembly 152 and generates and sends an electronic braking signal to the controller 126. The controller 126 receives this electronic braking signal and interprets the signal to electronically coordinate the movement of the linked handles 52 to the stowed position or the non-stowed position. In embodiments including the aforemention servo motor that is used to move the handles 52, the controller 126 commands the respective servo motor of the at least two of the linked handles 52 to rotate or otherwise move in a like manner, i.e., to rotate or move in a coordinated manner in either the first or second direction to the stowed or non-stowed position, as described above on the basis of the received electronic braking signal.

More specifically, when the brake assembly 140 is moved to the engaged or braked position, the brake sensor 164 senses a change in position of the foot pedal 150 or other component of the brake actuator assembly 152 and generates and sends a first electronic braking signal to the controller 126. The controller 126 receives this first electronic braking signal and interprets the first electronic braking signal to electronically coordinate the movement of the linked handles 52 to the stowed position. In certain embodiments, the controller 126 commands the respective servo motor of the at least two of the linked handles 52 to rotate or otherwise move in a like manner, i.e., to rotate or move in a coordinated manner in either the first or second direction to the stowed position on the basis of the received first electronic braking signal.

Conversely, when the brake assembly 140 is moved to a disengaged or unbraked position, the brake sensor 164 senses a change in position of the foot pedal 150 or other component of the brake actuator assembly 152 and generates and sends a second electronic braking signal to the controller 126. The controller 126 receives this second electronic braking signal and interprets the second electronic braking signal to electronically coordinate the movement of the linked handles 52 to the non-stowed position. In certain embodiments, the controller 126 commands the respective servo motor of the at least two of the linked handles 52 to rotate or otherwise move in a like manner, i.e., to rotate or move in a coordinated manner in either the first or second direction to the non-stowed position on the basis of the received second electronic braking signal In related embodiments, the brake assembly 140 may also be moved electronically between the engaged and disengaged position. In these embodiments, the brake assembly 140 comprises a motor 160 is coupled to the plurality of gears 154, and a brake selector 162 (see FIGS. 1 and 5), which is coupled to the motor 160. The activation or deactivation of the brake selector 162 by a user sends an electronic braking signal to the controller 126, which processes the electronic braking signal and generates a responsive command signal that is sent to the motor 160 to rotate the motor 160, with the rotation of the motor 160 being translated through the plurality of gears 154 of the brake actuator assembly 152 to the engageable device 156 to move the engageable surface into, or out of, contact with the support wheel 56 as described above.

The brake selector 162 may be in the form of a button, dial, sliding switch, touch sensor, toggle switch or the like that is moveable between an on position (to move the brake assembly to the engaged or braked position) and an off position (to move the brake assembly 140 to the disengaged or unbraked position). In one representative embodiment, the brake selector 162 is in the form of a button having an on position for placing the brake assembly 140 in the braked position and an off position for placing the brake assembly 140 in the unbraked position.

An alternative brake assembly that could be used in the patient transport apparatus 20 is described in U.S. patent application Ser. No. 16/210,876, entitled "Patient Transport Apparatus with Electro-Mechanical Braking System," filed on Dec. 5, 2018, the disclosure of which is hereby incorporated by reference in its entirety. It should be appreciated that other configurations of the brake assembly other than that described herein or incorporated by reference are also contemplated.

In one exemplary embodiment, the brake selector 162 may be located on the base 24 at the head end of the patient transport apparatus 20, and one at the foot end of the patient transport apparatus 20. As illustrated, in FIGS. 1-4, a brake selector 162 in the form of a depressible button is illustrated at the head end of the patient transport apparatus 20. In other embodiments, the brake selector 162 may be an input on a control panel coupled to the controller 126, and may be placed at any suitable location on the patient transport apparatus 20.

In certain embodiments, actuation of the brake selector 162 by the user generates first and second electronic braking signals interpreted by the controller 126 as corresponding to the user's desire to place the brake assembly 140 in either the engaged or disengaged state. For instance, the brake selector 162 may comprise a pair of switches with a first switch being activated to engage the brake assembly 140 and generate the corresponding first electronic braking signal that is sent to the controller 126 as described above, whereas activation of the second switch by the user generates the second electronic braking signal that is sent to the controller 126. The controller 126 receives the first electronic braking signal and electronically coordinates the movement of the linked handles 52 to the stowed position in response to receiving the first electronic braking signal. Conversely, when the controller 126 receives the second electronic braking signal, the controller 126 electronically coordinates the movement of the linked handles 52 to the non-stowed position. In embodiments including the afore-mentioned servo motor that is used to move the handles 52, the controller 126 commands the respective servo motor of the at least two of the linked handles 52 to rotate or otherwise move in a like manner, i.e., to rotate or move in a coordinated manner in either the first or second direction to the stowed or non-stowed position, as described above on the basis of the received first or second electronic braking signal.

In still further embodiments, the controller 126 is configured to delay the movement of the linked pair of handles 52 to the stowed position, upon the placement of the brake assembly 140 in the engaged or braked position for a predetermined amount of time after receipt of the first electronic braking signal. A small delay will allow the user of the patient transport apparatus 20 to temporarily set the brake assembly 140 and perform some function without having the handles 52 move to the stowed position. By way of example, a user may want to place the brake assembly 140 in the braked state, thereby preventing movement of the patient transport apparatus 20, when the patient transport apparatus 20 is loaded onto an elevator to move between floors of a building, wherein the movement of the handles 52 may not be desirable.

In associated further embodiments, the controller 126 is configured to delay the movement of the linked pair of handles 52 to the non-stowed position upon the movement of the brake assembly 140 to the disengaged or unbraked position for a predetermined amount of time after receipt of the second electronic braking signal. This can allow the user to be properly positioned prior to the coordinated movement of the handles 52 to the non-stowed position.

This predetermined amount of time of the delay of movement may be as short as a few seconds, such as about 1-5 seconds, or as long as a couple of minutes, such as about 1-10 minutes. In certain embodiments, the predetermined amount of time of the delay of movement ranges from 1 second to 5 minutes.

FIG. 5 illustrates the control system 124 of the patient transport apparatus 20. The control system 124 comprises the controller 126 coupled to the various electronically controllable devices on the patient transport apparatus 20, including the user input device 130, the brake assembly 140 (including the brake actuator assembly 152, the brake selector 162, and the brake sensor 164), and the actuator devices 200. In certain further embodiments, the control system 124 is also coupled to the throttles 92, the lift actuator 66, and the powered drive system 90.

The controller 126 comprises one or more microprocessors for processing instructions or for processing algorithms stored in memory 127 to carry out the functions described herein. Additionally or alternatively, the controller 126 may comprise one or more microcontrollers, subcontrollers, field programmable gate arrays, systems on a chip, discrete circuitry, and/or other suitable hardware, software, or firmware that is capable of carrying out the functions described herein. The controller 126 may be carried on-board the patient transport apparatus 20, or may be remotely located. In one embodiment, the controller 126 is mounted to the base 24, but can be mounted in any suitable location. Memory 127 may be any memory suitable for storage of data and computer-readable instructions. For example, the memory 127 may be a local memory, an external memory, or a cloud-based memory embodied as random access memory (RAM), non-volatile RAM (NVRAM), flash memory, or any other suitable form of memory. Power to the various components of the patient transport apparatus 20 may be provided by a battery power supply 128 and/or external power source 129.

In one embodiment, the controller 126 comprises an internal clock to keep track of time. In one embodiment, the internal clock is a microcontroller clock. The microcontroller clock may comprise a crystal resonator; a ceramic resonator; a resistor, capacitor (RC) oscillator; or a silicon oscillator. Examples of other internal clocks other than those disclosed herein are fully contemplated. The internal clock may be implemented in hardware, software, or both. In some embodiments, the memory 127, microprocessors, and microcontroller clock cooperate to send signals to and operate the various components shown in FIG. 5 to meet predetermined timing parameters.

The controller 126 is configured to transmit and/or receive input/output signals to/from the various components shown in FIG. 5. The controller 126 may communicate with these components via wired or wireless connections to control the various components shown, to control other components not represented in FIG. 5, and/or to otherwise carry out the functions described herein. In particular, the controller 126 is configured to transmit and/or receive input/output signals to/from the various components in order to coordinate the movement of the at least two handles 52 of the user interface 50, as described above.

In alternative embodiments, as opposed to or in conjunction with the electronically linking the components to initiate the coordinated movement of the at least two handles 52 of the user interface 50 as described above, the at least two handles 52 of the user interface 50 may be linked together mechanically. In these embodiments, manual input by a user to move one of the linked at least two handles 52 of the user interface 50 from the stowed position to the non-stowed position results in the coordinated movement of the other one or more linked handles 52 from the stowed position to the non-stowed position. Similarly, manual input by a user to move one of the linked handles 52 of the user interface 50 from the non-stowed position to the stowed position results in the coordinated movement of the other one or more linked handles 52 from the non-stowed position to the stowed position. In certain embodiments, only mechanical linking of the at least two handles 52 of the user interface 50 is included. In other embodiments, both electronic and mechanical linking occurs, which allows the user to coordinate the movement of the at least two handles 52 mechanically via user input to move the handles 52, or electronically as described above.

The mechanical linking of the at least two handles 52 of the user interface 50 may be accomplished in a variety of ways. For example, the handles 52 may be linked by mechanical cables (such as push/pull cables), one or more shafts (such as a flexible shaft or flex shaft), and the like, that are operatively coupled to and/or extend between each of the at least two handles 52. Other forms of linkage are also contemplated that mechanically link the handles 52. In certain of these embodiments, additional linkage devices, such as u-joints or gear assemblies, may be utilized. Exemplary mechanical linkage of at least two handles 52 for use herein are also described in U.S. patent application Ser. No. 16/397,421, entitled "Patient Transport Apparatus Having Powered Drive System Utilizing Coordinated User Input Devices," filed on Apr. 30, 2018, the disclosure of which is hereby incorporated by reference in its entirety. It should be appreciated that other configurations of the mechanical linking of the handles 52 are also contemplated.

The present disclosure thus provides a simple and efficient way for positioning at least two handles 52 of a user interface 50 in a non-stowed position in a coordinated manner for use by the user to move the patient transport apparatus 20, and coordinated movement to move the at least two handles 52 to a stowed position in a coordinated manner which is less obstructive when patient transport apparatus 20 is not in use or is otherwise in a braked state.

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A patient transport apparatus comprising:

a support structure;

a plurality of support wheels coupled to the support structure and arranged for engagement with floor surfaces;

a drive assembly operatively attached to the support structure and including:

a drive member arranged for engagement with floor surfaces; and a powered drive system coupled to the drive member to selectively propel the drive member along floor surfaces;

a first handle and a second handle each respectively moveable between a stowed position and a non-stowed position, with a linkage operatively coupling the first and second handles in a coordinated manner such that movement of the first handle from the stowed position to the non-stowed position causes movement of the second handle from the stowed position to the non-stowed position and such that movement of the first handle from the non-stowed position to the stowed position causes movement of the second handle from the non-stowed position to the stowed position;

a user interface operatively attached to the first handle and including a user input device arranged for selective engagement by a user to operate the drive assembly in the non-stowed position; and a controller disposed in communication with the user interface and the powered drive system of the drive assembly to operate the powered drive system to propel the drive member along floor surfaces in response to user engagement with the user interface.

2. The patient transport apparatus of claim 1, wherein the drive member of the drive assembly is further defined as a drive wheel arranged for engagement with floor surfaces.

3. The patient transport apparatus of claim 1, wherein the drive assembly further includes an actuator operatively coupled to the drive member and arranged to move the drive member relative to floor surfaces.

4. The patient transport apparatus of claim 1, wherein the user input device is further defined as a throttle supported by the first handle for concurrent movement with the first handle between the stowed position and the non-stowed position, the throttle being arranged for rotation relative to the first handle in response to user engagement.

5. The patient transport apparatus of claim 1, wherein the user interface further includes a touch sensor arranged for user engagement; and wherein the controller is further configured to electronically coordinate movement of the first and second handles between the stowed position and the non-stowed position in response to changes in user engagement with the touch sensor of the user input device.

6. The patient transport apparatus of claim 5, wherein the controller is further configured to coordinate movement of the first and second handles to the non-stowed position in response to detecting user engagement with the touch sensor of the user input device.

7. The patient transport apparatus of claim 5, wherein the user input device is configured to transmit a first input signal and a second input signal to the controller, the controller being configured to coordinate movement of the first and second handles to the stowed position upon receiving the first input signal and to coordinate movement of the first and second handles to the non-stowed position upon receiving the second input signal.

8. The patient transport apparatus of claim 1, wherein the patient transport apparatus further comprises a brake assembly coupled to at least one of the plurality of support wheels and being moveable between a braked position and an unbraked position, the brake assembly being configured to generate an electronic braking signal; and wherein the controller is disposed in communication with the brake assembly and is configured to electronically coordinate movement of the first and second handles to the stowed position in response to receiving the electronic braking signal from the brake assembly.

9. The patient transport apparatus of claim 8, wherein the controller is configured to electronically coordinate movement of the first and second handles to one of the stowed position and the non-stowed position upon receipt of the electronic braking signal.

10. The patient transport apparatus of claim 8, wherein the controller is further configured to delay coordinated movement of the first and second handles to the stowed position for a predetermined amount of time after receipt of the electronic braking signal.

11. The patient transport apparatus of claim 8, wherein the brake assembly includes:

a brake actuator assembly arranged to operate at least one of the support wheels between the braked position and the unbraked position; and a brake input device coupled to the brake actuator assembly and arranged for user engagement to move the brake actuator assembly between the braked position and the unbraked position.

12. The patient transport apparatus of claim 11, wherein the brake input device comprises a foot pedal.

13. The patient transport apparatus of claim 11, wherein the brake assembly further includes a brake sensor to generate the electronic braking signal, with the brake sensor being arranged to determine operation between the braked position and the unbraked position.

14. The patient transport apparatus of claim 13, wherein the electronic braking signal is further defined as a first electronic braking signal and the brake sensor is configured to generate the first electronic braking signal when the brake assembly is moved to the braked position; and wherein the brake sensor is further configured to generate a second electronic braking signal when the brake assembly is moved to the unbraked position.

15. The patient transport apparatus of claim 14, wherein the controller is configured to electronically coordinate movement of the first and second handles to the stowed position upon receipt of the first electronic braking signal.

16. The patient transport apparatus of claim 14, wherein the controller is configured to electronically coordinate movement of the first and second handles to the non-stowed position upon receipt of the second electronic braking signal.

17. The patient transport apparatus of claim 1, further comprising an actuator device coupled to the user interface and disposed in communication with the controller to drive movement of the first and second handles between the stowed position and the non-stowed position.

18. The patient transport apparatus of claim 17, wherein the actuator device includes at least one servo motor.

19. The patient transport apparatus of claim 1, wherein the patient transport apparatus further comprises a brake assembly operatively attached to the support structure and including:

a brake actuator assembly arranged to operate at least one of the support wheels between a braked position and an unbraked position, and a brake input device coupled to the brake actuator assembly and arranged for user engagement to move the brake actuator assembly between the braked position and the unbraked position; and wherein the controller is disposed in communication with the brake assembly and is configured to electronically coordinate movement of the first and second handles between the stowed position and the non-stowed position in response to changes in operation of the brake actuator assembly between the braked position and the unbraked position.

20. The patient transport apparatus of claim 19, wherein the brake assembly further includes a brake sensor arranged to determine operation between the braked position and the unbraked position; and wherein the controller is further configured to electronically coordinate movement of the first and second handles the stowed position in response to changes in operation of the brake actuator assembly to the braked position determined by the brake sensor.

* * * * *